United States Patent [19]

Barbieri

[11] 4,004,362

[45] Jan. 25, 1977

[54] ADHESIVE WIRE MARKER

[75] Inventor: Joseph C. Barbieri, Jackson Township, Washington County, Wis.

[73] Assignee: W. H. Brady Co., Milwaukee, Wis.

[22] Filed: Sept. 29, 1975

[21] Appl. No.: 617,556

[52] U.S. Cl. ..... 40/316; 40/2 R; 174/112; 206/813; 206/820; 428/40; 428/41; 428/43

[51] Int. Cl.[2] ..... H01B 7/36; G09F 3/10

[58] Field of Search ..... 174/112; 40/2 R, 144, 40/316, 20; 283/21; 428/40; 206/820, 813

[56] References Cited

UNITED STATES PATENTS

| | | | |
|---|---|---|---|
| 1,563,371 | 12/1925 | Jones | 283/21 |
| 2,372,994 | 4/1945 | Welch | 40/316 |
| 2,665,509 | 1/1954 | Flood | 40/20 R |
| 2,831,277 | 4/1958 | Strachan | 40/316 |
| 2,975,091 | 3/1961 | Tobey | 428/41 |
| 3,466,217 | 9/1969 | Mott | 428/41 |
| 3,892,901 | 7/1975 | Smith | 428/41 |

*Primary Examiner*—George F. Lesmes
*Assistant Examiner*—R. J. Roche
*Attorney, Agent, or Firm*—Quarles & Brady

[57] ABSTRACT

A wire marker comprising an assembly of (1) an adhesive element for carrying identification information that has pressure sensitive adhesive on one of its surfaces and (2) a backing covering the adhesive on the adhesive member, wherein the assembly has a pair of spaced apertures through which a wire to be marked is inserted, after which the backing can be removed from the adhesive element and the adhesive element folded over to form an identification flag on the wire.

2 Claims, 10 Drawing Figures

ADHESIVE WIRE MARKER

BACKGROUND OF THE INVENTION

1. Field

This invention relates to a marker adapted to be applied to an electrical wire for identification thereof.

2. Prior Art

Wire markers of the type which are particularly useful during assembly or manufacturing operations involving electrical wires, such as when a harness of wires is to be wired into suitable assembly, generally have been clip-like devices or sleeves which can be inserted about an electrical wire and permanently fastened thereto when desired. Heat shrinkable plastic sleeves, for example, are often used for such purposes.

The present invention provides a construction wherein a label having a layer of pressure sensitive adhesive is particularly adapted for use as a wire marker through the provision of structure which enables the marker to be loosely applied to a wire so that it can be moved as desired during manufacturing operations, and then affixed and permanently placed to identify the wire at the desired time.

SUMMARY OF THE INVENTION

My present invention provides an adhesive wire marker comprising, in combination:

1. a label having a layer of pressure sensitive adhesive on one of its surfaces,
2. a backing covering the pressure sensitive adhesive layer on the label, and
3. a pair of spaced apertures formed through the label and the backing.

When the wire marker of the above construction is to be applied to an electrical wire, or similar conduit, to be marked, the wire is inserted through the two spaced apertures with the backing and the label still joined together. In this condition, the assembly can be moved along the wire, thereby facilitating the assembly of the wire to its final connection. When it is desired to permanently affix the marker to the wire, the backing is stripped away from the label and the label folded upon itself and so that contacting portions of its pressure sensitive adhesive layer are joined together to thereby form a flag for identification of the wire. The label itself may be preprinted with any suitable alphanumeric legend, or the assembly may be supplied to the end-user with the label blank so that he can print it with selected data such as by use of computer print-out apparatus, typewriter, pencil, etc.

My present invention has among its main objects: the provision of a pressure sensitive adhesive marker which can be used to identify wires that embodies the structure which will enable temporary movable positioning of the marker on a wire and thereafter permanent application of the marker about the wire; the provision of a pressure sensitive adhesive label and backing combination having spaced apertures through which a wire is inserted; and the provision of adhesive wire markers which can be supplied blank to an end-user and that he may apply his desired legend by any selected means which will best fit into his manufacturing and assembly operations. A more specific object of this invention is to provide the particular structural details for an adhesive wire marker as hereinafter disclosed or claimed.

DESCRIPTION OF THE PREFERRED EMBODIMENT(S)

a. FIGS. 1–7

Figure 1:
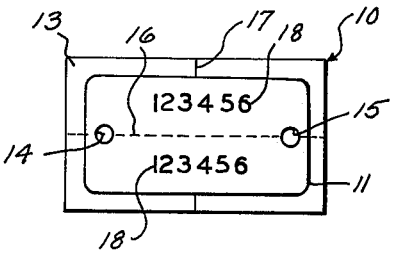
FIG. 1 illustrates in plan view the front of an adhesive wire marker of the present invention.
Figure 2:
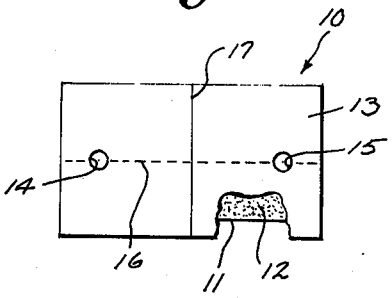
FIG. 2 illustrates in plan view the back of the wire marker of FIG. 1.
Figure 3:
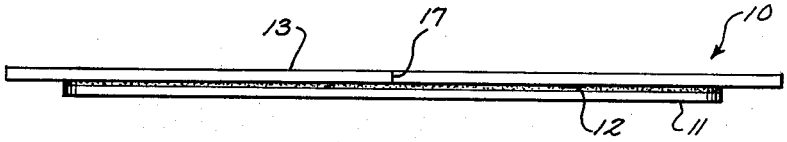
FIG. 3 is a cross-sectional view of the wire marker shown in FIGS. 1–2.

A wire marker 10 according to the present invention is illustrated in front view of FIG. 1 and in rear view in FIG. 2 as comprising an adhesive element 11 having a layer 12 of pressure sensitive adhesive on one of its surfaces (see also FIG. 3) and a backing 13 covering the adhesive layer 12 and extending slightly beyond the borders of the adhesive element 11. Two spaced apertures 14 and 15 are formed to extend through both the adhesive element 11 and the backing 13, being spaced approximately on the longitudinal center line of the wire marker 10 as illustrated in this specific embodiment. A perforated line 16 extends across the center line of the wire marker and is formed to pass through both elements 11 and 13. Turning now to FIG. 2, the backing 13 is divided into two parts by the slit line 17, each joined to the adhesive layer 12. An identifying legend such as a numerical code 18 shown in FIG. 1 can be applied to either or both halves of the adhesive element 11 of the wire marker.

Figure 4:
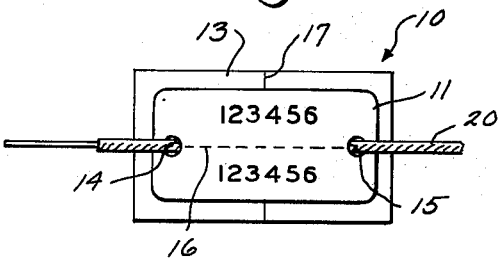
FIG. 4 shows the initial step of inserting the wire marker about an electrical wire.
Figure 5:
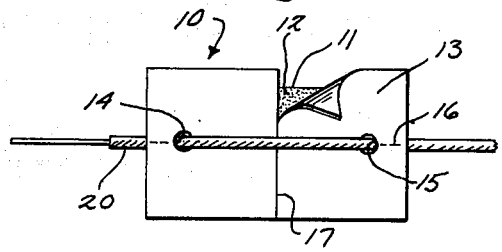
FIG. 5 shows an intermediate step illustrating the start of removal of the backing element from the pressure sensitive label element of the wire marker.
Figure 7:
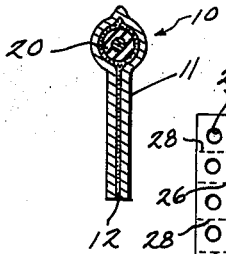
FIG. 7 is a vertical sectional view of the assembly shown in FIG. 6.
Figure 6:
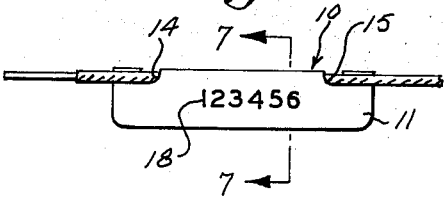
FIG. 6 shows the wire marker of the present invention when in its final condition about a wire to be identified.
Figure 8:
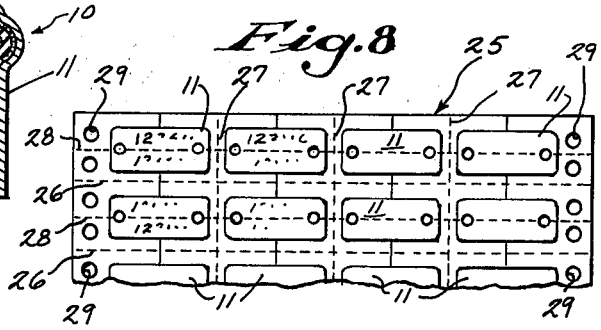
FIG. 8 is a plan view showing a particularly useful form in which the present adhesive wire markers can be supplied to an end-user.

FIGS. 4–7 illustrate the application of the wire marker 10 to an electrical wire 20. As shown in FIG. 4, the wire 20 is inserted through the spaced apertures 14 and 15 of the wire marker 10, in which condition the wire marker can be conveniently moved along the wire as desired by the worker while still being retained in position on the wire. Thus if the wire is to be connected to an assembly at its bare end, the assembler can place the wire marker 10 in any desired location convenient to his work when the wire marker is in the position of FIG. 4. Once it is desired to permanently affix the wire marker to identify the wire 20, turning now to FIG. 5, a portion of the backing 13 is grasped by hand and peeled away from the adhesive element 11 and when both halves of the backing are removed in this fashion, the adhesive layer 12 of the adhesive element 11 is fully exposed. Thereupon, turning next to FIG. 6, the adhesive element 11 is folded so that its two halves are superimposed upon one another and joined together along the pressure sensitive adhesive layer 12. This step forms a flag-like identification member attached to the wire 20 with the legend 18 visible for future identification of the wire. The final condition is as illustrated in FIG. 7.

b. FIG. 8

Figure 9:
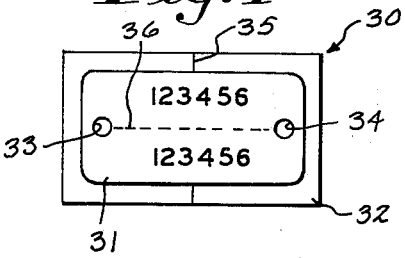
FIG. 9 is a plan view of a second embodiment of a wire marker of this invention.

FIG. 8 illustrates an assembly of wire markers according to the present invention in a form which is convenient for supplying to many end-users. A sheet 25 of backing material carries a number of adhesive elements 11 arranged in rows. The sheet 25 is suitably die-cut to form individual backing members 13 by means of horizontal perforated lines 26 and intersecting vertical perforated lines 27. Another set of horizontal perforated lines 28 is formed in the sheet 25 to develop the perforated line 16 in the individual wire markers. Near each edge of the sheet 25, a row of guide-apertures 29 is formed so that the sheet 25 can be guided through suitable printing or other types of apparatus. The assembly 25 as illustrated in FIG. 8 is a particularly useful form for furnishing blank adhesive elements 11 which the end-user can feed into a computer print-out apparatus and apply his own selected legends to each adhesive element.

c. FIG. 9

Figure 10:
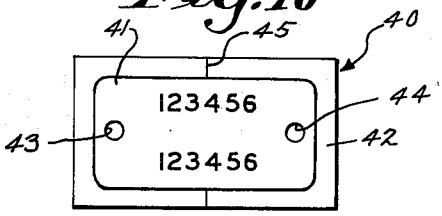
FIG. 10 is a plan view of a third embodiment of a wire marker according to this invention.

A second embodiment of the present invention is illustrated in FIG. 9 as comprising a wire marker 30 having an adhesive element 31 carried on a backing 32 with spaced perforations 33 and 34 extending through the adhesive and backing elements, and with the backing separating into two portions by a slit 35. In this embodiment, a perforated line 36 is formed to extend only between the apertures 33 and 34 as compared to the perforated line 16 of FIG. 1 which extended entirely across the wire marker 10.

d. FIG. 10

A third embodiment of the invention is shown in FIG. 10 as comprising a wire marker 40 formed of an adhesive element 41 carried on a backing 42, with spaced apertures 43 and 44 formed to extend through both the elements 41 and 42 and with a slit 45 formed to divide the backing into two halves. This third embodiment of the invention does not employ any longitudinal perforated slit lines between the apertures as was the case with the previous two embodiments, and is also suitable for the practice of the present invention.

The adhesive element and backing element of the above-described wire markers may be made of paper, plastic film or metal foil materials as generally used in the label art. The backing material should have an inherent release characteristic in relation to the pressure sensitive adhesive layer on the adhesive element or carry a suitable release coating, so that the adhesive layer is releasably joined thereto, by which is meant that the adhesive does not unduly transfer onto the backing from the adhesive element when the backing is separated therefrom. The terms "pressure sensitive", "release coating", and "adhesive transfer" are used herein in accordance with the definitions set forth in the Glossary of Terms published by the Pressure Sensitive Tape Council in their publication dated October, 1963 revised July, 1974.

The wire marker constructions of the present invention enhances the use of pressure sensitive adhesive materials in wire markers, can be applied to a wire and moved as required before being fixed into final position, and can also be supplied to the end-user in an unprinted form so that he may apply his specific identification or other type of legend in any manner suitable to his particular processing capabilities.

I claim:

1. An adhesive wire marker assembly comprising, in combination:

a. an adhesive element having a pressure sensitive adhesive layer on one of its surfaces, b. a backing element releasably joined to the pressure sensitive adhesive layer of the adhesive element, c. a pair of spaced apertures extending through both the adhesive element and the backing element and adapted to receive a wire therethrough, d. the backing element being separable from the adhesive element after a wire has been inserted through the spaced apertures and the adhesive element being foldable upon itself for joinder along the pressure sensitive adhesive layer after removal of the backing element to thereby form a flag-like marker for a wire inserted through the apertures, and e. a perforated line defined across the adhesive element and the backing element intersecting the spaced apertures and extending through both the adhesive element and the backing element.

2. A sheet having a plurality of adhesive wire marker assemblies comprising, in combination:

a. a sheet of backing material, b. a row of guide-apertures formed along each of two opposed edge portions of the sheet of backing material, c. a row of spaced horizontal perforated lines extending across the sheet of backing material, d. a row of spaced vertical perforated lines extending across the sheet of backing material and intersecting the row of horizontal lines, said horizontal lines and vertical lines dividing the sheet of backing material into a plurality of backing elements, e. a plurality of adhesive elements, each having a layer of pressure sensitive adhesive, arranged on the sheet of backing material with each adhesive element releasably joined to a backing element along its layer of pressure sensitive adhesive, f. a pair of spaced apertures formed through each adhesive element and its respective backing element, the apertures being adapted to receive a wire therethrough, and g. the sheet being divisible into individual wire marker assemblies, each comprising an adhesive element and a backing element with the backing element separable from the adhesive element after a wire has been inserted through the spaced apertures and the adhesive element being foldable upon itself for joinder along the pressure sensitive adhesive layer after removal of the backing element therefrom to form a flag-like marker for a wire inserted through the apertures.

* * * * *